US008092279B2

(12) United States Patent
Parrish

(10) Patent No.: US 8,092,279 B2
(45) Date of Patent: Jan. 10, 2012

(54) SHARPENING SYSTEM FOR SCISSORS WITH COMPLEX CURVED BLADES

(76) Inventor: Charles Ryan Parrish, Ocala, FL (US)

( * ) Notice: Subject to any disclaimer, the term of this patent is extended or adjusted under 35 U.S.C. 154(b) by 522 days.

(21) Appl. No.: 12/378,268

(22) Filed: Feb. 12, 2009

(65) Prior Publication Data

US 2010/0203810 A1 Aug. 12, 2010

(51) Int. Cl.
*B24B 1/00* (2006.01)
*B24B 3/52* (2006.01)

(52) U.S. Cl. ..... 451/45; 451/282; 451/293

(58) Field of Classification Search ..... 451/45, 451/293, 273, 377, 371, 193, 321, 405, 272, 451/282

See application file for complete search history.

(56) References Cited

U.S. PATENT DOCUMENTS

| | | | | |
|---|---|---|---|---|
| 1,958,021 | A * | 5/1934 | Schmidt | 451/45 |
| 4,984,391 | A | 1/1991 | Sattler | |
| 5,157,870 | A | 10/1992 | Pike | |
| 5,291,690 | A * | 3/1994 | Pike | 269/45 |
| 5,624,304 | A * | 4/1997 | Pasch et al. | 451/287 |
| 7,118,466 | B2 | 10/2006 | Laney | |
| 7,959,494 | B1 * | 6/2011 | Pietrzak | 451/45 |
| 2008/0020681 | A1 * | 1/2008 | Leyva | 451/45 |

* cited by examiner

*Primary Examiner* — Hadi Shakeri
(74) *Attorney, Agent, or Firm* — Sven W. Hanson

(57) ABSTRACT

A device and method of sharpening hair cutting scissor blades passes a blade over the perimeter portion of a flexible sharpening pad to flex the perimeter portion out of the plane of the pad. The blade is held in an angled orientation over the pad and is moved horizontally and downward during the sharpening motion. Independent horizontal and vertical movements allow addressing irregularly shaped blades including blades with a radial shape and convex blades.

2 Claims, 3 Drawing Sheets

SHARPENING SYSTEM FOR SCISSORS WITH COMPLEX CURVED BLADES

BACKGROUND OF THE INVENTION

The present invention pertains to devices and methods for sharpening scissors, in particular scissors designed for personal hair cutting. Hair scissors, or shears as they are often called, are precise instruments that require careful periodic sharpening to provide quality performance. The cutting surfaces of such scissors may be flat but are more commonly curved in more than one direction to optimize cutting with a minimum of force and drag on the hair. In particular, it is popular for scissor blades to be curved, from root of the cutting surface near the handle to the tip. Blades with an 600 to 1000 millimeter blade shape radius are very popular and are used on many of the best scissors for hair cutting. Similarly, the scissor cutting surface is often convex shaped. The result, in a scissors with a radius and convex shape, is a complex cutting surface.

When scissors blades are sharpened, it is critical that the existing shape of the cutting surfaces be maintained. This is relatively simple for scissors with straight and flat blades, but this requirement is very difficult to meet with blades with complex blade surfaces such as found on a scissors with both a blade radius and convex face. Available sharpening devices have flat working surfaces. To properly sharpen a complex curved scissors blade with a flat sharpening device requires very precise and complicated movements. In many instances, improper sharpening results in flats or irregularities in the scissors shape and cutting surfaces and, effectively, a destroyed scissors blade.

There are prior art devices that attempt to provide accurate sharpening of curved scissor blades. For example, U.S. Pat. No. 7,118,466 to Laney provides a curved guide bar to attempt to limit the movement of a clamped scissor blade to a single preselected shape. However, at best, the Laney device is still dependent on proper user operation and without careful operation a blade can be ruined during sharpening. Also, due to the limitations of the Laney guide bar, it is difficult to sharpen any blade—such as a previously improperly sharpened blade—that deviates from the predefined shape.

There remains a demand for a scissors sharpening device that reduces the difficulty in sharpening curved scissor blades. Preferably, such a device will allow for sharpening blades with irregularities such as variable blade radius that have been produced from prior improper sharpening and that will duplicate the many flat and curved blades manufactured.

SUMMARY OF THE INVENTION

The present invention is a device, system and method for sharpening straight, curved and irregular shaped scissors blades. A generally flat sharpening surface is used, such as a conventional motor-driven rotating sharpening pad. A moving frame and blade holder or mount are provided to retain a scissors blade in preselected orientation to the sharpening pad. The frame provides independent linear horizontal and vertical movement to the blade mount that allows a mounted blade to be moved over and downward through the plane of the pad.

The blade holder also has a pivot providing a circular movement range about a pivot rotation axis that is parallel to, and above, the sharpening pad. The blade holder includes a blade retaining surface oriented such that a blade may be retained generally parallel to the rotation axis of the blade holder. The pivot and circular movement range provides for addressing any convex blade surface.

In inventive methods of sharpening, a scissors blade is retained in the blade holder of the device such that the blade may be moved into and below the horizontal plane of a sharpening pad. The long axis of the blade is angled with respect to the plane of the pad such that the blade surface can intersect and bear on a small flexible perimeter region of the pad. The blade surface is moved transversely, in a radially outward direction, over the perimeter region with a continuous uniform stroke. During this stroke a uniform downward pressure is exerted on the blade, through the blade holder, sufficient to force and retain a bend in the perimeter region and create a pad sharpening region parallel to the blade surface. To maintain this orientation during the outward stroke, the blade holder is moved linearly downward and, simultaneously and independently, linearly outward. Limits are provided to prevent horizontal movements of the blade holder that might damage the scissored blade.

In a preferred method step, the blade holder is rotated about its pivot while the held scissor blade surface is in contact with the sharpening pad to form a convex shape on the blade surface. This is repeated in a step-wise fashion as the blade moves over a transverse path over the pad perimeter to complete the convex shape over the entire length of the blade.

The invention includes a system for sharpening scissors blades that includes an integrated rotating sharpening pad, or may form an independent frame and holder for use with separate or attached conventional rotating sharpening pad devices.

Due to the high rate of use and sharpening of professional hair cutting scissors, their initial shapes are often altered. This makes more problematic effective sharpening. Scissor blade surfaces may have uneven shapes such as flats in curved surfaces. This fact makes many of the prior sharpening devices and methods ineffective in many situations. In particular, where sharpening is performed against a broad flat surface larger than the scissor blade, concave blades surfaces cannot be addressed. Prior methods that limit the scissor blade movement path during sharpening also suffer from an ability to adapt to any irregularity in blade shape. The present device and method enable sharpening of any of these blade shapes.

Additional novel aspects and benefits of the invention Will be discerned from the following description of particular embodiments and the accompanying figures.

DETAILED DESCRIPTION OF EMBODIMENTS OF THE INVENTION

Figure 1:
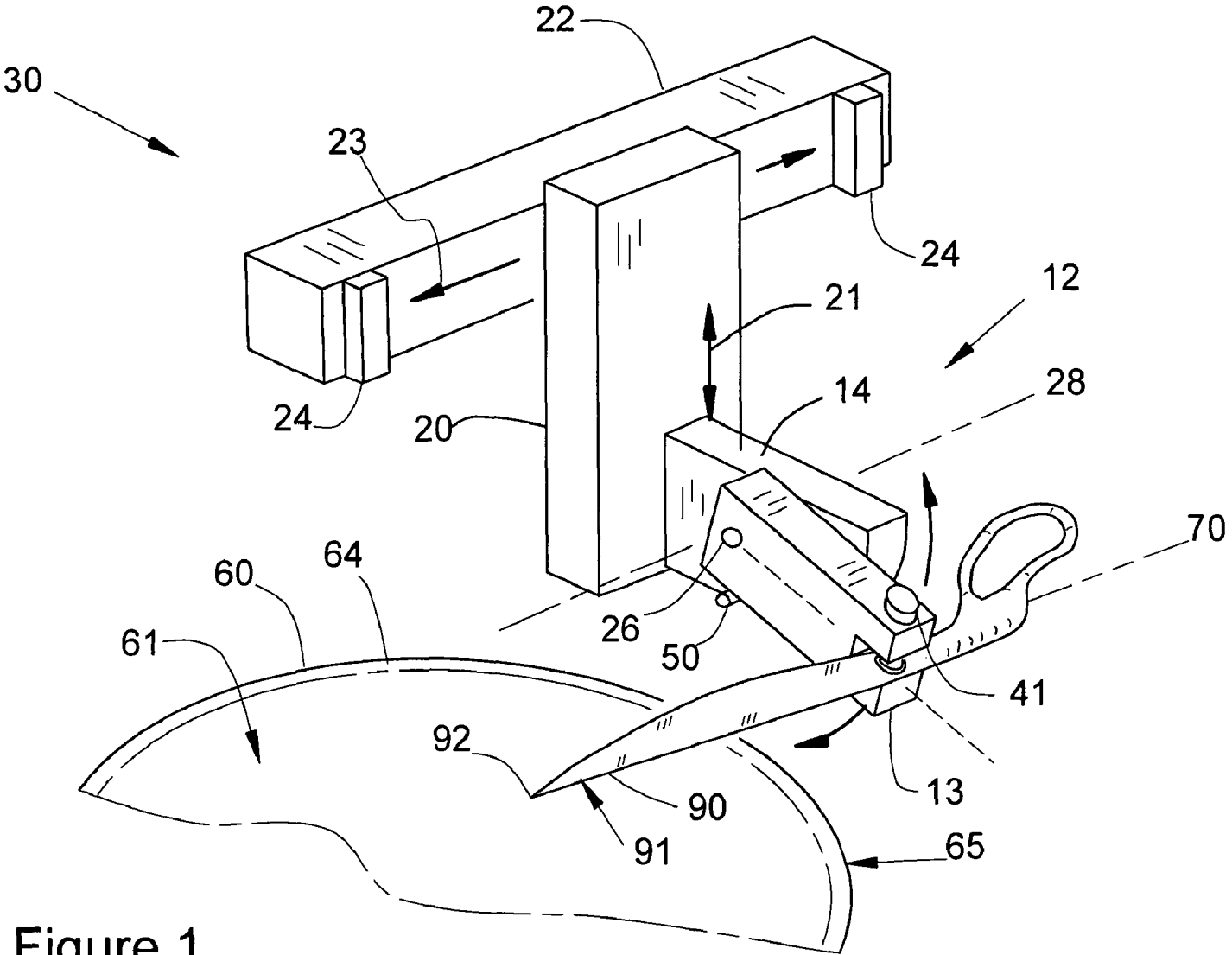
FIG. 1 is a perspective illustration of one embodiment of the inventive sharpening system, with frame elements depicted schematically.
Figure 2:
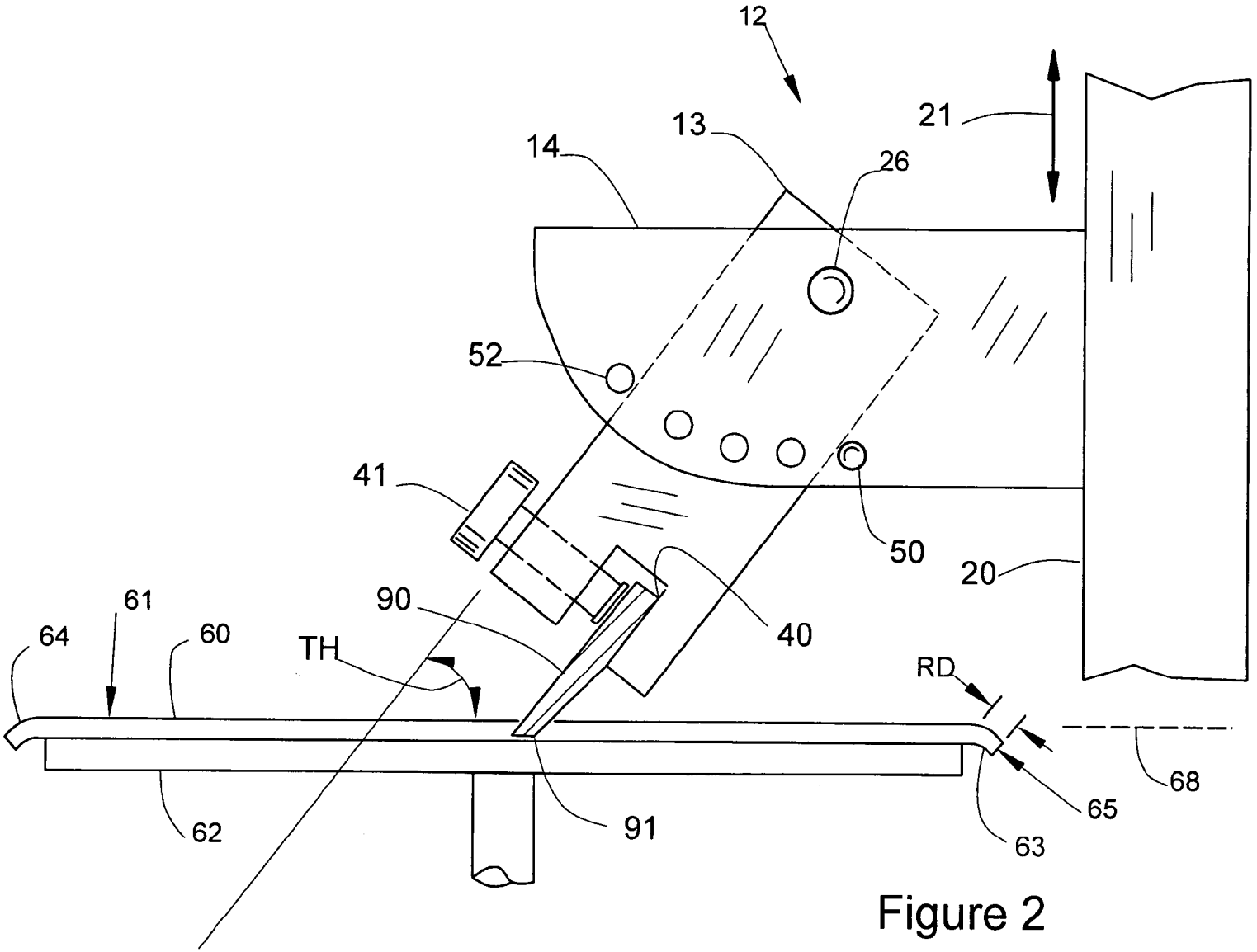
FIG. 2 is a side detail view of an exemplary conventional scissor blade held in the blade mount of the invention and showing the positional relation to a sharpening pad according to the invention system and methods.
Figure 3A:
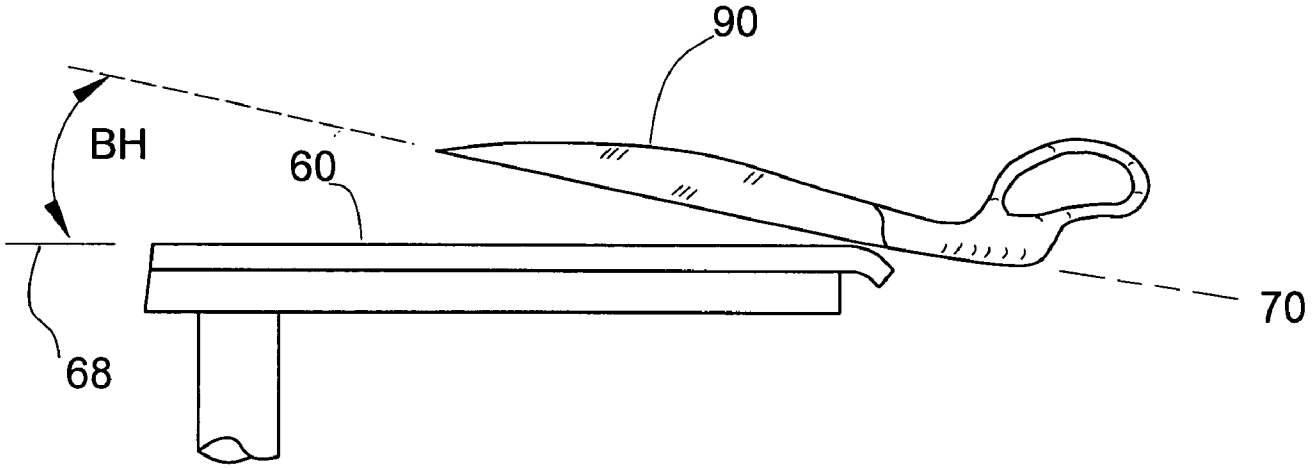
FIGS. 3*a* and 3*b* are front views of a scissor blade oriented in two positions respecting a sharpening pad in the inventive methods. For clarity, the inventive blade holder is not shown.

FIGS. 1, 2 and 3*a, b* depict various views of the same preferred embodiment of the invention. A single scissors blade 90 is depicted in the illustrations and it will be understood that this is one of a pair of matched blades that in use are pivotably joined to form a conventional "pair" of scissors.

The present invention is applicable to sharpening a broad variety of scissor blades, including straight blades and curved blades such as are often used in personal hair cutting; any of which might also feature a convex blade cutting surface 91.

In FIG. 1 a single scissor blade 90 is secured in a blade mount 12 that includes a rigid base 14 and a pivoting grip 13. The base 14 is slideably secured to a vertical guide rail 20 such that, in operation, the base 14 is enabled to move alternatively up or down on a vertical axis, as shown schematically by the associated movement arrow 21. The vertical rail 20 is coupled to, and moveable with respect to, a horizontal guide rail 22 which is fixed in a workplace. The horizontal rail 22 enables horizontal movement of the vertical rail 20, and hence the mount 12, as shown by the second schematic movement arrow 23.

The vertical rail 20 and horizontal rail 22 structures are shown schematically and their constructions may take any of a variety of alternative forms providing the same required functions and operations defined herein. Examples are conventional linear guide rails. Two perpendicular linear guide rails may be joined to provide the necessary structure and operation. In such a case, the base 14 would be slidably coupled to, or integral with, the moving platform of the vertical guide rail.

Together the vertical rail 20 and horizontal rail 22 are here named, for convenience, a movement "frame" 30. A critical feature of the frame 30 is the independence of vertical and horizontal movement provided to the blade mount 12 through the base 14. To clarify this independence requirement, vertical and horizontal movement of the blade mount 12 must be independent from each other at all points. This is necessary to enable addressing the infinitely variable blade shapes that exist in scissor blades in use at any time. The horizontal rail 22 includes two limiting stops 24 that define the extremes of horizontal movement of the device. The application of these stops 24 will be discussed below.

The grip 13 is secured to the base 14 through a pivot pin 26 that enables the grip 13 to pivot, relative to the base 14, about a horizontal pivot axis 28. It is critical that the pivot axis 28 be parallel to the axis of movement of the horizontal rail 22. At the distal end of the grip 13, a scissor blade mounting surface 40 and a clamp 41 form a blade mounting fixture for securing a blade 90 in the proper orientation for sharpening according to the inventive methods. The mounting surface 40 is preferably flat and parallel to the pivot axis 28, such that the pivot axis lies on the plane of the mounting surface 40. This flat construction will match the shape of most scissor blades in use today. However, the mounting surface 40 may, alternatively, be shaped to accommodate non-flat scissor blades so long as the effective result is that the blade 90 is secure in a plane including the pivot axis 28, as mentioned. This orientation is necessary to enable the proper movement of the blade 90 relative to a horizontal sharpening surface to produce a convex blade surface as discussed below. The clamp 41 is shown in the form of a threaded shaft with a manually operable turn knob and clamp face that secures the blade 90 against the mounting surface 40. Other clamping devices and methods may be likewise employed for the same result. In any case, it is critical that, in use, the blade be held rigid against the mounting surface 40.

It is important to control the angle of the grip 13 relative to the base 14. In the embodiment shown, this is accomplished through a control pin 50 that protrudes perpendicularly (horizontally) from the face of the base 14 and blocks further downward rotation of the grip 13. Upward rotation is limited by gravity, and, during sharpening operations, by the user's manual pressure on the grip 13. The control pin 50 is placed to provide the proper blade surface angle TH of the blade cutting surface 91 to the pad horizontal sharpening surface. A nominal blade angle of 40 to 80 degrees is found in many conventional hair cutting scissor blades. Various different angles may be enabled by providing several control pin holes 52 in which the control pin 50 may be, alternatively, placed. It is convenient to provide holes for increments of 5 degrees in blade angle TH. Other devices and means of limiting the range of the rotation of the grip 13 may be used as alternatives to the control pin 50 for the same function.

Sharpening of a scissor blade is accomplished by using a rotating (spinning) horizontal face pad 60. Preferably the pad is driven by an electric motor housed in a cabinet with appropriate controls. A conventional motor-driven flat hone may be used if the sharpening surface may be replaced. Many such hones have magnetic mounting disks on which the sharpening pad may be removably secured by magnetic attraction to the mounting disk 62. It is important that the center portion of the pad 60, or the mounting disk, be generally rigid. The pad 60 has a flat sharpening face surface 61 with an appropriate sharpening medium, such as aluminum oxide. Diamond grit may be used but is often too aggressive and tends to load up with metal. Various different pads with progressively finer grit may be used as in conventional sharpening methods. A finish pad with the equivalent of 1200 to 3000 grit is suggested for hair cutting scissors. Very fine diamond grit such as about three micron or smaller may be useful for polishing.

The sharpening pad is oriented with a horizontal pad plane 68 as shown in the figures. In the embodiment shown in the figures, the pad 60 consists of a somewhat flexible sheet that is mounted to a rigid metal supporting mounting disk 62. The pad 60 is larger in diameter than the mounting disk 62 such that an overhang portion 63 of the pad that results has no underlying support. The necessary radial dimension of the overhang portion 63 is dependent on the thickness and flexibility of the pad 60.

To enable the required flexing of the pad perimeter portion 64, the overhang portion 63 must be flexible. Conventional pads are formed of a variety of different materials including rigid metals with diamond grit surfaces. Such rigid pads cannot be used as they will not provide a flexed perimeter portion. Similarly, less rigid materials such as rubber or plastics will be unsuitable if too thick or the overhand too short. Rigid pads are incapable of providing a sharpening surface angled from the horizontal pad plane 68 as the flexed perimeter portion 64 provides in the invention. A rigid pad will provide only one-dimensional line bearing to an angled incident blade, likely destroying the blade in any attempted sharpening action. Note that conventional pads, including flexible pads, typically have uniform thickness and material properties, and therefore references herein to pad properties do not distinguish perimeter portion properties, however it should be understood that the critical properties are those of the perimeter portion 64.

During testing of a prototype, for a plastic pad having a thickness of 0.0017 inches, an overhang dimension RD of 0.063 inches was sufficient to provide an acceptably flexible pad perimeter region. A lesser radial overhand is not suggested as providing insufficient bearing surface for most pads. In the above prototype the ratio of overhand dimension RD to pad thickness is approximately 3.6. This is a suggested guide for acceptable overhand dimension RD for flexible pads of different thicknesses. This applies to pad materials of similar acceptable flexibility such as rubber and leather, both of which may be used.

Figure 3B:
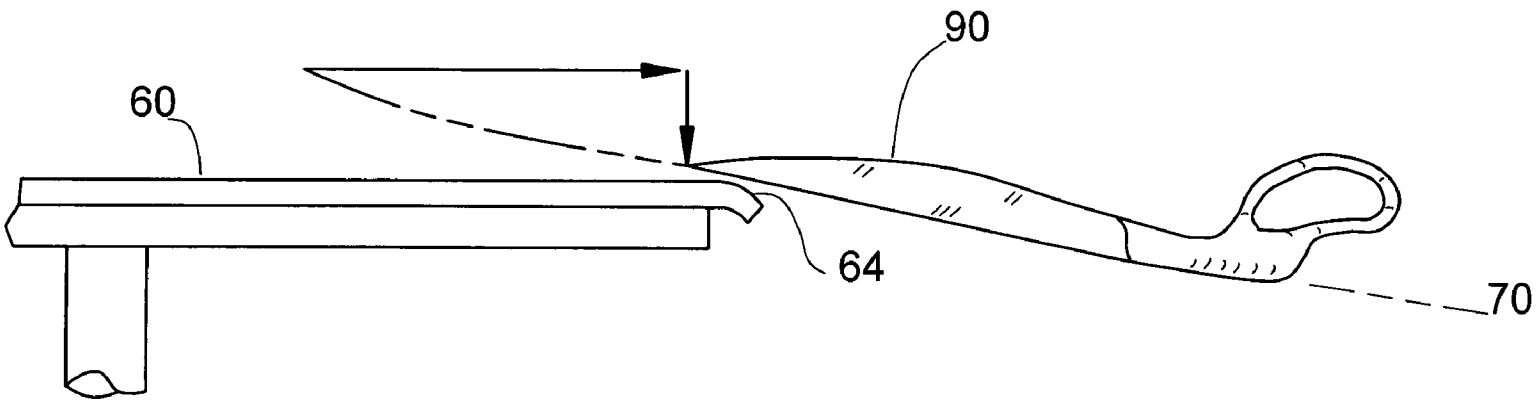

Examples of the inventive methods of sharpening will now be detailed during which the critical performance of the pad 60 will be explained. A long axis 70 of a scissor blade 90 is defined here as a line passing through the center of the blade 90 and parallel a line through the cutting surface tip 92 and root. Generally, during the inventive sharpening process, a scissor blade is held with the long axis 70 angled with respect to the pad plane 68 as shown in FIGS. 3*a* and 3*b* (in the figures, the left side of the pad 60 is truncated for clarity). This angle is maintained throughout the sharpening process (this point is quite distinct from prior sharpening methods which require parallel contact of the cutting surface to be sharpened with the flat face of the hone). The blade 90 is pressed against a perimeter portion 64 of the pad surface 61 with sufficient force to bend the overhang portion 63 and alter the orientation of the perimeter portion 64 and bring it parallel to the long axis 70. The amount of force required for this depends on the overhang and flexibility of the pad 60 and can be discerned by a user having average skill in conventional sharpening methods.

The above interaction of the blade 90 and pad 60 must only occur while both: the pad 60 is rotating at an effective speed for sharpening, and also the blade 90 is moving transversely outward. If at any time the blade 90 is stationary, a deleterious flat irregularity will be cut by the pad on the blade surface 91. Due to the angular orientation of the blade 90 respecting the pad, in order to maintain contact between the blade 90 and the pad 60, the blade 90 must be moved vertically downward at the same time as it is moved transversely outward as illustrated by the movement arrows in FIG. 3*b*.

The above described "outward" movement of the blade 90 is radial if the blade long axis 70 passes through the vertical centerline of rotation of the pad 60. The blade may located slightly off-center from this radial orientation during sharpening and still effect the same result. In such cases, the transverse movement is not quite radial. However, as long as the movement of the pad perimeter portion 64 is consistent and approximately perpendicularly across the blade surface 91, the inventive methods may be successfully carried out.

When sharpening blades that have a radius or are otherwise non-straight, as the blade 90 is moved outward, the blade angle BH between the pad plane 68 and the blade surface 91 at the point of contact will change. In many circumstances, this angle may be practically unknownable due to random irregularities formed in the blade during prior sharpenings, as discussed above. However, a unique benefit of the current method is that the flexing pad perimeter portion 64 accommodates these blade surface angular changes to provide a sharpening effect substantially equal over the entire blade surface 91, regardless of angle changes. In FIG. 3*a* the blade angle BH is shown as the nominal angle between the blade axis 70 and the pad plane 68. This is precisely true for a straight blade surface, but only an approximation for a curved or irregular surface, where the actual angle BH at the point of contact may be greater or less than the nominal angle.

However, in the just described method, to allow the blade 90 to be maintained in contact with the perimeter portion 64 it is also necessary that the vertical and horizontal movements of the blade 90 be independent as the relationship between them is unknowable in the same manner as the angle BH. For this reason, the operation of the vertical rail 20 must be independent of the horizontal rail 22. Constructions that proscribe or limit the range or relationship of the two axes of motion will be unable to accommodate irregular blade shapes and therefore are contrary to the present invention.

In a preferred method, a blade is fixed in the grip 63 as shown in the figures. The mount 12 is then manipulated by the user to locate the blade 90 with the root of the blade surface 91 vertically above and separated from the perimeter portion 64. In a single continuous motion, the mount 12 is moved simultaneously downward and outward, to push the blade 90 against the pad, flexing the perimeter portion 64, and drawing the entire length of the surface 91 over the flexed perimeter portion 64. The mount 12 and blade 90 are raised from the pad when the tip 92 of the blade reaches the perimeter portion 64. This movement of the blade 90 should be substantially with consistent speed and pressure. It is critical that movement of the blade not continue to allow the tip 92 to impinge the edge of the pad 60.

Depending on the amount of metal that must be removed to sufficiently sharpen a blade, the above step may be repeated. By using a fine grit pad and light pressure, sharpening may be accomplished using multiple passes without removing too much metal. Multiple passes will reduce the effect of any inconsistencies in movement speed and pressure.

As illustrated in FIG. 1, the horizontal rail 22 includes two stops 24 which define the extent or ends of the range of horizontal position of the vertical rail 20, and therefore of the mount 12. The stops 24 are shown schematically and may take the form of physical blocks or other means of arresting or limiting the range of possible horizontal locations of the device. Conventional guide rails typically employ adjustable slide blocks that are acceptable. The stops 24 are preferably adjustable. Before beginning sharpening of a particular blade, the stops 24 are adjusted to define a range of motion for the mount 12 that allows the full length of the mounted blade to be passed over the perimeter portion 64. At the same time, when properly positioned according to the invention, the stops define a range of motion in which the blade tip 92 remains radially inside or within the perimeter portion 64. To clarify this feature: the defined range of motion does not allow the blade tip 92 to be located radially outside the pad 60. This limit is critical to allowing the user to move the mount 12 through the sharpening movements, as described above, with assurance that the tip 92 will not be allowed to contact the extreme edge 65 of the pad. Such contact is likely to destroy the pad 60 and may result in damage to the scissor blade 90. With the stops 24 properly in place, the sharpening movement may be consistently continued by the user until one of the stops 24 prevents further movement. The user may wait to sense the abrupt stop before raising the blade 90 from the pad 60.

Optionally, a convex blade surface may be also shaped or reshaped by the following steps. Herein and typically, "convex" refers to the surface shape in a plane perpendicular to the long axis 70. Preferably after the blade has been sharpened along its long axis as described above, the blade grip 13 is rotated (upward) about its pivot 26 while a clamped scissor blade surface is in contact with the sharpening pad 60 to form a convex shape on the blade surface. This is repeated in a step-wise fashion as the blade 90 repeats its transverse path over the pad perimeter to complete the convex shape over the entire length of the blade 90. A specific rotation angle is somewhat dependent on the existing convex shape of the particular blade, but generally rotating the grip 13 through an angle of 10 to 15 degrees while maintaining a light pressure on the pad 60 will be effective. To maintain blade contact with the pad 60, the mount 12 must be moved downward without horizontal movement. Multiple passes may be necessary and this may be determined by examination by a generally skilled user at the time.

The embodiment of the figures is configured for sharpening right-hand scissor blades. However, the same device may be used for left-hand scissors by altering the relative placement of the pad 60 (and rotation) and reversing the orientation of the blade 90 in the mount grip 13. The particular vertical location of the horizontal rail 22 is not critical and may be above or below the pad 60 so long as the described location and movement of the mount 12 is provided.

The elements of the mount 12 may be formed of structural metals or other alternative materials having similar properties. The structural elements of the base 14 may be integrated into the vertical rail 20 so long as the defined movements of the mount 12 are provided.

For convenience, the inventive device may include an enclosure or housing including an integrated sharpening device including a replaceable pad 60. Alternatively, the inventive device may be configured to accept a conventional sharpening hone with an appropriate horizontal pad. In such a case, the enclosure or other integrating structure must provide for proper orientation of the hone with the frame 30. The invention includes using conventional sharpening hones by their application with structures as described above to enable the inventive methods.

The preceding discussion is provided for example only. Other variations of the claimed inventive concepts will be obvious to those skilled in the art. Adaptation or incorporation of known alternative devices and materials, present and future is also contemplated. The intended scope of the invention is defined by the following claims.

The invention claimed is:

1. A hair scissor blade sharpening method comprising:

securing a scissor blade in a first condition above and across a perimeter portion of a rotating horizontal surface of a sharpening pad, with the blade tip higher than the blade handle;

moving a cutting surface of the blade rigidly downward against the perimeter portion with sufficient force to flex the perimeter portion downward and parallel the cutting surface while simultaneously continuously moving the cutting surface transversely outward and over the perimeter portion;

halting the blade when the blade tip contacts the perimeter portion in a second condition wherein a portion of the blade is below and outside the perimeter portion, and then immediately moving the blade vertically upward.

2. A hair scissor blade sharpening method, according to claim 1, and further comprising:

returning the blade to the first condition, and subsequently;

moving the blade cutting surface downward against the perimeter portion with sufficient force to flex the perimeter portion downward and parallel the cutting surface while simultaneously rotating the blade about a horizontal axis such as to form a convex shape onto the cutting surface;

moving the blade in step-wise fashion while repeatingly forming a convex shape over the length of the cutting surface.

* * * * *